US007025000B1

(12) United States Patent
Wong et al.

(10) Patent No.: US 7,025,000 B1
(45) Date of Patent: Apr. 11, 2006

(54) MECHANISM FOR REDUCING THE VULNERABILITY OF HIGH EXPLOSIVE LOADED MUNITIONS TO UNPLANNED THERMAL STIMULI

(75) Inventors: Roger S. Wong, Maplewood, NJ (US); Henry T. Rand, Jr., Nyack, NY (US); Jeff Ranu, West Paterson, NJ (US); Charles William Oakley, Whippany, NJ (US); Michael E. Ivankoe, Jr., Chatham, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/692,357

(22) Filed: Oct. 24, 2003

Related U.S. Application Data

(63) Continuation of application No. 10/122,109, filed on Apr. 11, 2002, now abandoned.

(51) Int. Cl.
*F42B 39/00* (2006.01)

(52) U.S. Cl. ..... 102/481

(58) Field of Classification Search ..... 102/481, 102/445

See application file for complete search history.

(56) References Cited

U.S. PATENT DOCUMENTS 3,665,857 A * 5/1972 Radnich et al. ..... 102/481
3,927,791 A * 12/1975 Hershberger ..... 220/89.4
4,004,516 A * 1/1977 Johnson et al. ..... 102/499
4,022,130 A * 5/1977 Johnson et al. ..... 102/481
4,365,556 A * 12/1982 Reibel ..... 102/307
4,411,199 A * 10/1983 Yates et al. ..... 102/481
4,549,487 A * 10/1985 Jensen ..... 102/498
5,035,181 A * 7/1991 Jacks et al. ..... 102/481
5,155,298 A * 10/1992 Koontz ..... 102/481
5,939,662 A * 8/1999 Bootes et al. ..... 102/473
6,338,242 B1 * 1/2002 Kim et al. ..... 60/204

* cited by examiner

*Primary Examiner*—Teri Pham Luu
*Assistant Examiner*—Susan C. Alimenti
(74) *Attorney, Agent, or Firm*—Michael C Sachs; John F. Moran

(57) ABSTRACT

A new mechanism substantially reduces the vulnerability of explosive load munitions to thermal stimuli, such as fire or heat during transport and storage, thus enhancing personnel safety and the survivability of adjacent munitions. The mechanism includes a threaded fuze adapter made of plastic and having a melting temperature that is lower than the auto-ignition temperature of the explosive. The adapter secures a fuze or metal closing plug to an explosive loaded projectile and is designed to permit venting of combustion gases through the nose of the projectile upon auto-ignition of the explosive, thereby preventing detonation of the explosive and fragmentation of the projectile body. A plastic or metal ring is utilized to support the body of an explosive loaded projectile within a fiberboard packing tube, thus allowing the fuze to readily separate from the projectile body upon the melting of the plastic threaded fuze adapter and subsequent combustion of the explosive during an unplanned thermal stimulus event. An intumescent coating is deposited on the metal ammunition container that is used to package explosive loaded cartridges, to reduce the rate of thermal stimuli to the munitions, thereby ensuring that the plastic fuze adapter of the present invention reaches its melting temperature prior to the explosive attaining its auto-ignition temperature.

12 Claims, 5 Drawing Sheets

MECHANISM FOR REDUCING THE VULNERABILITY OF HIGH EXPLOSIVE LOADED MUNITIONS TO UNPLANNED THERMAL STIMULI

REFERENCE TO PREVIOUS APPLICATIONS

This application is a continuation of application Ser. No. 10/122,109 filed on Apr. 11, 2002 now abandoned by Roger Wong, et al. for Mechanism For Reducing The Vulnerability Of High Explosive Loaded Munitions To Unplanned Thermal Stimuli, which application itself claims benefit under 35 USC 119(e) of provisional application 60/282,884 filed Apr. 10, 2001, the entire file wrapper contents of which applications are hereby incorporated by reference herein as though fully set forth at length.

U.S. GOVERNMENT INTEREST

The invention described herein may be made, used, or licensed by or for the U.S. Government for U.S. Government purposes.

FIELD OF THE INVENTION

The present invention relates in general to the field of Insensitive Munitions (IM) used by the U.S. Armed Forces, and it particularly relates to a new mechanism for reducing the vulnerability of explosive loaded munitions to unplanned thermal stimuli.

BACKGROUND OF THE INVENTION

High explosive munitions are an essential part of the arsenals of armed forces. Logistic operations of the armed forces frequently involve the transportation of high explosive munitions from manufacturing plants to ammunition storage depots, Ammunition Supply Points (ASP) and magazines, throughout the world. For military sites located within a national boundary, ground transportation is preferred and commonly conducted by rail or trucking freight. For military sites located overseas, the transportation of munitions includes ships and airplanes.

Explosive loaded munitions are transported and stored in manners intended to minimize risks of accidental detonation. However, accidents such as an overturned tractor trailer, a train derailment, or a cargo plane crash can occur during transport of the munitions. In some instances, the ensuing fire and heat resulting from the accident could provide sufficient thermal stimuli to cause the munitions to detonate. In such an event, a chain explosion could result from sometimes a single munition explosion. To minimize such a risk of accidental explosions, the United States Department of Defense requires that all munitions and weapons withstand unplanned stimuli such as heat from fire, shock from blast, and impact from fragments and bullets. This requirement is termed Insensitive Munitions (IM).

To meet the Insensitive Munition requirement, munitions must pass Fast Cook-Off (FCO) and Slow Cook-Off (SCO) test requirements, as established by MIL-STD-2105B, "Military Standard for Hazard Assessment Tests for Non-Nuclear Munitions". In a typical Fast Cook-Off test, the munition is engulfed in the flames of a jet fuel (or gasolene) fire exhibiting a minimum average temperature of 1,600° F., to assess its response to rapid heating. In the Slow Cook-Off test, the munition is heated in a closed chamber at a linear rate of 6° F. (or 50° F.) per hour until a reaction occurs, to assess its response to gradual heating. The FCO and SCO tests are considered to be passed if the munition exhibits a Type V response where the test items only burn or scatter parts less 50 feet away from the burn pan or test oven.

SUMMARY OF THE INVENTION

It is a feature of the present invention to provide a new mechanism for high explosive munitions that substantially reduces the vulnerability of explosive load munitions to thermal stimuli such as fire or heat during transportation and storage, thus enhancing personnel safety and the survivability of adjacent munitions. Further, the munitions design of the present invention is capable of meeting the Insensitive Munitions requirements according to the MIL-STD-2105B specifications.

To this end, the new munitions design of the present invention incorporates a number of novel design features, including the following:

1. A threaded fuze adapter made of plastic having a melting point lower than the auto-ignition temperature of the explosive, secures a fuze or metal closing plug to an explosive loaded projectile and is designed to permit venting of combustion gases from the burning explosive through the nose of the explosive loaded projectile, thereby preventing an accidental detonation of the explosive loaded projectile.
2. A plastic or metal ring is incorporated into a fiberboard packaging tube of the present invention to support the projectile body of an explosive loaded cartridge, thus allowing a fuze or metal closing plug to readily separate from the projectile body upon the melting of the plastic threaded fuze adapter of the present invention and subsequent combustion of the explosive during an unplanned thermal stimulus event.
3. An intumescent coating is deposited on a metal ammunition container that package the explosive loaded cartridges in accordance with the present invention to reduce rate of thermal stimuli to the munitions, thereby ensuring that the plastic fuze adapter of the present invention reaches its melting point prior to the explosive attaining its auto-ignition temperature.

The foregoing and other features and advantages of the present invention are realized by a mechanism that incorporates the following design features such as a threaded plastic fuze adapter, an improved packaging tube with a support ring for the projectile body, and an intumescent coating deposition on a metal container holding the improved packaging tubes.

BRIEF DESCRIPTION OF THE DRAWINGS

The features of the present invention and the manner of attaining them, will become apparent, and the invention itself will be understood by reference to the following description and the accompanying drawings, wherein:

FIG. 6 is comprised of FIGS. 6A, 6B, 6C, wherein

Similar numerals in the drawings refer to similar elements. It should be understood that the sizes of the different components in the figures might not be in exact proportion, and are shown for visual clarity and for the purpose of explanation.

DETAILED DESCRIPTION OF PREFERRED EMBODIMENTS

Figure 1:
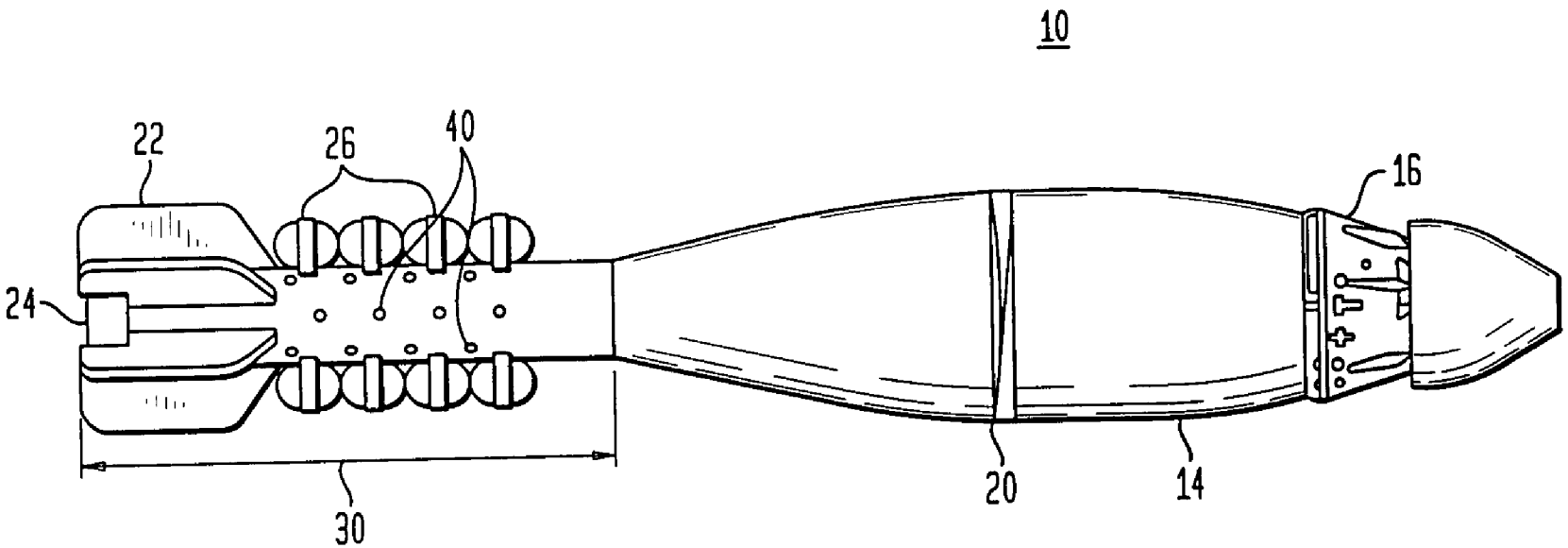
FIG. 1 is a side view of an explosive loaded cartridge made according to the present invention.
Figure 2:
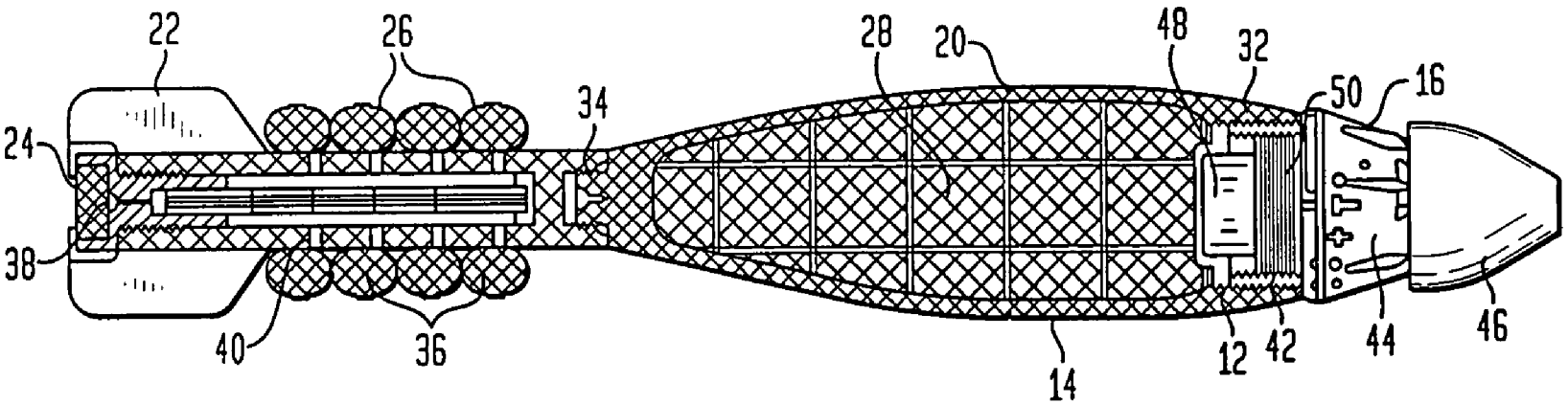
FIG. 2 is a cutaway view of the explosive loaded cartridge of FIG. 1, shown with a threaded plastic fuze adapter of the present invention for securing the fuze to the nose of the explosive loaded projectile.

FIGS. 1 and 2 illustrate an explosive loaded cartridge 10 incorporating a threaded fuze adapter 12 (FIG. 2) made according to the present invention. An exemplary explosive loaded cartridge 10 is the 60 mm M720A1 cartridge, to be manufactured and used by the U.S. Armed Forces. The explosive loaded cartridge 10 is comprised of a number of major components, namely: a fuze 16, a threaded fuze adapter 12, a projectile body 14, a main charge explosive 28, a tail fin 22, a propelling charge 26 and an ignition cartridge 24. Each of these components will now be described in more detail.

The fuze 16 is generally a threaded body 50, with a tapered midsection 44 and nose 46. The fuze 16 of the explosive loaded cartridge 10 is secured to the threaded opening 32 of the projectile body 14 via the plastic fuze adapter 12. An exemplary fuze 16 used in conjunction with the exemplary 60 mm M720A1 cartridge is the Multi-option M734A1 fuze.

Figure 3A:
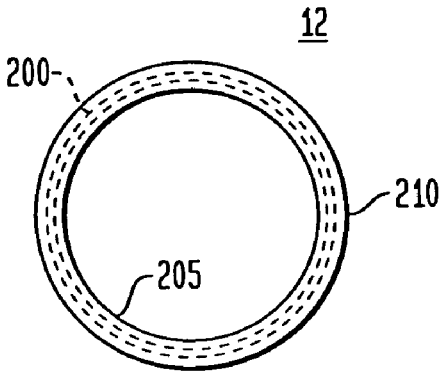
FIG. 3 is comprised of FIGS. 3A and 3B that respectively illustrate a cross-sectional view and a side view of the plastic threaded fuze adapter of FIG. 2 made according to the present invention.
Figure 3B:
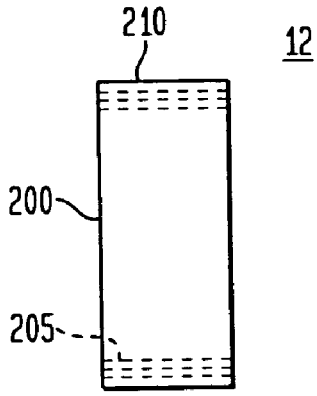

The aft section of the fuze body 50 is typically comprised of a threaded metal base 42, with a Safing and Arming (S&A) device (not shown), an explosive lead charge (not shown) and an explosive booster 48 within its interior volume. The S&A device, lead charge and booster 48 are designed to initiate and detonate the main charge explosive 28 in the projectile body 14. The S&A device generally holds a stab or electrically initiated detonator, which is "out-of-line" with the lead charge and booster 48 until the explosive loaded cartridge 10 has been fired from the weapon and the fuze 16 has armed. Following a firing of the explosive loaded cartridge 10, the armed fuze 16 detonates the main charge explosive 28, after it electronically senses or impacts the target. The ensuing explosion causes the projectile body 14 to break up into lethal fragments. The lead charge and booster 48 are typically made of a pressed explosive, such as Composition A5 (also known as COMP A5) and PBXN 5. PBXN-5 explosive is used for the booster 48 in the exemplary Multi-option M734A1 fuze because it reacts less violently than COMP A5 explosive when subjected to thermal stimuli. The threaded metal base 42 is engaged to the interior surface 205 (FIGS. 3A, 3B) of the plastic fuze adapter 12 of the present invention, which, in turn, is engaged to the threaded opening 32 of the projectile body 14, by means of its exterior threaded surface 210 (FIGS. 3A, 3B). When the fuze 16 is engaged to the projectile body 14, the booster 48 is situated immediately adjacent to the main charge explosive 28 inside the projectile body 14.

Figure 4:
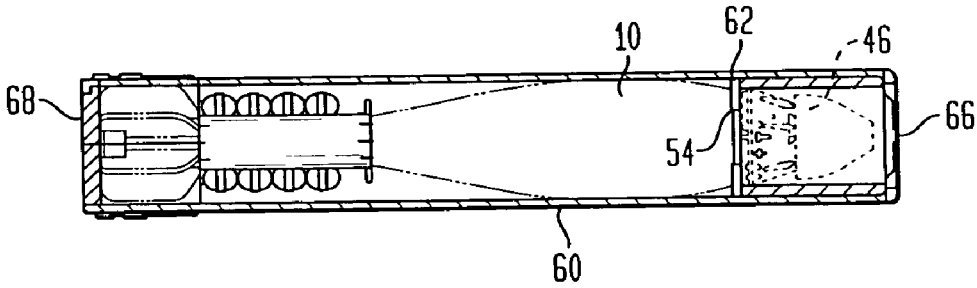
FIG. 4 (PRIOR ART)
FIG. 4 is side view of a conventional fiberboard packaging tube shown supporting the fuze of an explosive loaded cartridge of FIG. 1.

A plurality of slots 54 are typically formed on the exterior surface of the fuze body 50, at the base of the tapered midsection 44. The slots 54 are designed to accept a wrench or fork-shaped tool for assembling the fuze 16 to the projectile body 14. A metal, U-shaped clip 62 (FIG. 4) is commonly inserted into the slots 54, to support an explosive loaded cartridge 10 within a fiberboard packaging tube 60 (FIG. 4). The metal packing clip 62 (FIG. 4) is not utilized when the explosive loaded cartridge 10 is packaged in an improved fiberboard packaging tube 70 (FIG. 5) of the present invention, which will be a subject for a further description in subsequent details.

The tapered midsection 44 and nose 46 of the fuze body 50 generally house the mechanical and/or electronic components that initiate the detonator in the S&A device after the fuze 16 electronically senses or impacts the target. An electronic, radio frequency (RF) transceiver/firing circuit board and a turbine alternator are housed under the truncated, conical shaped, metallic windshield and plastic nose assembly of the exemplary Multi-option M734A1 fuze.

Referring now to FIGS. 3A and 3B, the threaded fuze adapter 12 of the present invention is generally made of a cylindrical ring 200 having a threaded interior surface 205 as well as a threaded exterior surface 210. The fuze adapter 12 attaches the fuze 16 to the projectile body 200 by means of its interior and exterior threaded surfaces 205, 210. As used in conjunction with the exemplary 60 mm M720E1 cartridge, the threaded fuze adapter 12 has a nominal inside thread diameter (I.D.) of 1½ inches, nominal outside thread diameter (O.D.) of $1\frac{11}{16}$ inches and a length (L) of approximately 0.64 inch.

The threaded fuze adapter 12 is made of a material, e.g. an ionomer plastic, having a melting temperature sufficiently below the auto-ignition temperature of the main charge explosive 28 in the projectile body 14. A typical melting point of the fuze adapter material would be about 200° F. For the exemplary 60 mm M720A1 cartridge, a FORMION$^R$ Fl-120 plastic is utilized. During an unplanned thermal stimulus such as an exposure to external heat or fire source, the threaded fuze adapter 12 is melted upon reaching its melting temperature prior to the main charge explosive 28 reaching its auto-ignition temperature. Upon melting of the threaded fuze adapter 12, the fuze 16 is no longer physically secured to the projectile body 14, thereby enabling the fuze 16 to freely separate from the projectile body 14. As the thermal stimulus continues to heat the explosive loaded cartridge 10, the main charge explosive 28 begins to burn upon reaching its auto-ignition temperature. The burning explosive 28 produces combustion gas, which generates pressure within the internal volume of the projectile body 14. As the gas pressure begins to build, the fuze 16 is expelled from the projectile body 14, thereby enabling the combustion gas to pass through and out the threaded opening 32. Venting of the combustion gas and relief of the internal pressure prevents the burning reaction of the main charge explosive 28 from developing into an uncontrolled detonation and fragmenting the projectile body 14. Thus, the threaded fuze adapter 12 enhances personnel safety and the survivability of adjacent munitions in a fire, by preventing accidental explosion and fragmentation of an explosive loaded cartridge 10.

The projectile body 14 is generally made of a forged, high fragmenting, steel alloy shell. The thickness of the projectile body 14 is roughly 3/16 inch to 1/4 inch. The ogival shape of the projectile body 14 is designed to reduce the aerodynamic drag on the explosive loaded cartridge 10 during flight. Approximately mid position of the projectile body 14, an obturating ring 20 is circumferentially fitted within an external groove. During launch, the obturating ring 20 expands to seal the high pressure, propellant combustion gas behind the projectile body 14 as it travels up the mortar barrel. The sealing action allows the explosive loaded cartridge 10 to be propelled the maximum distance downrange. The projectile body 14 has a threaded opening 32, which accepts the fuze 16 via the threaded fuze adapter 12 and allows the main charge explosive 28 to be loaded therein. The projectile body 14 connects to the tail fin 22 via a threaded boss 34 located at the aft end.

With more specific reference to FIG. 2, the main charge explosive 28 is typically a melt-castable explosive such as Composition B (also known as COMP B) and PAX-21. PAX-21 explosive is used in the exemplary 60 mm M720A1 cartridge because of its reduced shock sensitivity and predictable behavior in unconfined burns. COMP B explosive and PAX-21 explosive have auto-ignition temperatures of about 380° F. and 314° F., respectively. As used herein, auto-ignition temperature means a temperature at which the explosive 28 starts to combust upon subject to thermal stimuli.

The tail section 30 of the explosive loaded cartridge 10 is comprised of a tail fin 22, a propelling charge 26 and an ignition cartridge 24. The tail fin 22 generally consists of a plurality of fin blades attached to a cylindrical boom which assembles to the projectile body 14. The fin blades are circumferentially attached to the boom at equal angular spacing and are generally trapezoidal shaped with rounded corners. The tail fin 22 provides the necessary stability control to maintain a proper flight path of the explosive loaded cartridge 10 to the target. An exemplary tail fin 22 used in conjunction with the exemplary 60 mm M720A1 cartridge is the six bladed, aluminum alloy M27 fin. The propelling charge 26 is fitted onto the boom of the tail fin 22, between the fin blades and projectile body 14. The ignition cartridge 24 is housed within the boom of the tail fin 22, opposite the end that assembles to projectile body 14. A plurality of vent holes 40 extending through the boom of the tail fin 22 enables the ignition cartridge 24 to ignite the propelling charge 26.

The propelling charge 26 is generally comprised of horseshoe shaped, containers filled with a propellant charge 36. Typically, the containers are made of a combustible, felted fiber material and the propellant charge 36 is a single or double based propellant. An exemplary propelling charge 26 used in conjunction with the exemplary 60 mm M720A1 cartridge is the four-increment, M235 propelling charge.

The ignition cartridge 24 is designed to function and ignite the propelling charge 26 when the explosive loaded cartridge is fired from the weapon. It typically has a percussion primer 38, black powder pellet and a propellant charge therein. An exemplary ignition cartridge 24 used in conjunction with the exemplary 60 mm M720A1 cartridge is the M702 ignition cartridge. The explosive loaded cartridge 10 is fired from the weapon by loading it, tail section 30 first, into the muzzle of the mortar barrel. Upon release, it slides down the barrel and impacts a firing pin at the bottom. The firing pin strikes and initiates the percussion primer 38 of the ignition cartridge 24. The percussion primer 38 initiates the black powder pellet, which in turn ignites the propellant charge contained within the ignition cartridge 24. The hot combustion gas and flame from the ignition cartridge flashes through the vent holes 40 in the fin boom and ignites the propelling charge 26. The combustion gas pressure generated by the ignition cartridge 24 and propelling charge 26 propels the explosive loaded cartridge 10 up the barrel and out to the target. In order for the threaded fuze adapter 12 to function as described earlier upon an occurrence of a thermal stimulus, an improved packaging method for the explosive loaded cartridge 10 is provided by the present invention. To understand the need for a new packaging method of the present invention, it might be beneficial to describe a conventional munition packaging method according to a prior art.

With reference to FIG. 4, a conventional packaging method for the explosive loaded cartridge 10 includes a fiberboard tube 60 and a U shaped, metal support clip 62. The fiberboard tube 60 is generally made of a cylindrical casing with a stationary end cap 66 and a removable end cap 68. The explosive loaded cartridge 10 is encased within the fiber tube 60 and is positively restrained by the metal support clip 62 attached to the fuze 16 via the wrench slots 54. A small gap exists between the fuze 16 of the explosive loaded cartridge 10 and the stationary end cap 66. In the event of an unplanned thermal stimulus, the metal support ring 62 and stationary end cap 66 would restrain the fuze 16 in place and prevent the release of the fuze 16 upon a melting of the threaded fuze adapter 12. The pressure generated by the combustion gas upon the ignition of the main charge explosive 28 would build up and might not be sufficiently relieved from the broken joint resulting from the threaded fuze adapter 12, thus causing a potential detonation of the explosive loaded cartridge 10 with an ensuing fragmentation of the projectile body 14.

Figure 5:
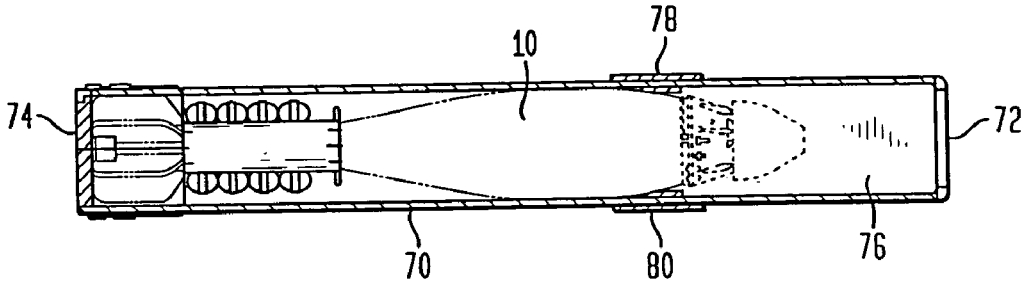
FIG. 5 is a side view of a fiberboard packaging tube for securing the explosive loaded cartridge of FIG. 1 incorporating the projectile body support ring of the present invention.

With reference to FIG. 5, it illustrates an improved packaging enclosure 70 according to the present invention; the explosive loaded cartridge 10 is encased within a fiberboard tube 70. An exemplary fiberboard tube 70 for use with the exemplary 60 mm M720A1 cartridge is the PA 164 fiber tube. The fiberboard tube 70 is generally made of a cylindrical casing with a stationary end cap 72 and a removable end cap 74. The tail fin 22 of the explosive loaded cartridge 10 is positioned against the removable end cap 74, thus enabling the explosive loaded cartridge 10 to be loaded or removed in a rearward manner.

The fiberboard tube 70 has an overall length sufficiently greater than the length of the explosive loaded cartridge 10 such that a sufficient space 76 exists between the tip of the nose 46 of the fuze 16 and the stationary end cap 72. A support ring 78 provides a positive restraint of the explosive loaded cartridge 10.

Figure 6A:
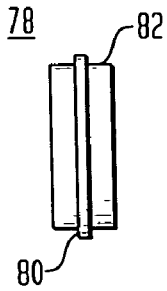
FIG. 6A is a side view of the support ring of FIG. 5.
Figure 6B:
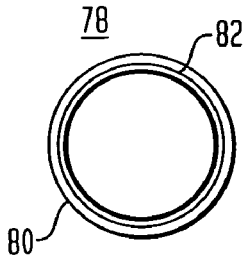
FIG. 6B is a front (or rear) view of the support ring.
Figure 6C:
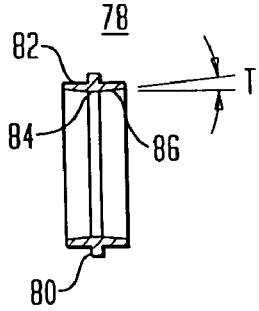
FIG. 6C is a cross-sectional view of the support ring of FIG. 6B.

With further reference to FIGS. 6A, 6B, 6C, the support ring 78 is attached to the fiberboard tube 70 and engaged with the explosive loaded cartridge 10 in the ogive region of the projectile body 14. The support ring 78 is generally formed of a plastic cylindrical shell 82 with a circular flange 80 that is peripherally located along the mid section of the cylindrical shell 82 of the support ring 78.

When used for supporting the exemplary 60 mm M720A1 cartridge, the cylindrical shell 82 typically has a nominal inside diameter (I.D.) of approximately 2.15 inch, and a length of approximately 0.875 inch. The outer surface of the cylindrical shell 82 is generally 2.40 inches in diameter. The inner surface of the cylindrical shell 82 is comprised of a straight surface 84 and two tapered surfaces 86.

The straight inner surface 84 spans approximately one third the length of the cylindrical shell 82, while the tapered inner surfaces 86 occupies the remaining length of the cylindrical shell 82. The tapered inner surface 86 has a taper that is generally conforms to the curvature of the projectile body 14 at the point of contact there between to provide a positive restraint of the explosive loaded cartridge 10 within the fiberboard tube 70. When used for supporting the exemplary 60 mm M720A1 cartridge, the tapered inner surface 86 has a taper angle (T) of approximately 70.

The circular flange 80 is generally formed on the outer surface of the cylindrical shell 82 at the mid length. When used for supporting the exemplary 60 mm M720A1 cartridge, the flange 80 has a thickness of about 0.125 inch and an outer diameter of 2.69 inches. The flange 80 is designed to secure the support ring 78 to the fiberboard tube 70.

In a manner of the storage of the explosive loaded cartridge 10 in the fiberboard tube 70 as illustrated in FIG. 5, in the event of an unplanned thermal stimulus, upon the melting of the threaded fuze adapter 12, the space 76 enables the fuze 16 to freely and completely separate from the projectile body 14, thereby enabling the threaded fuze adapter 12 to achieve its fullest function as intended.

Figure 7A:
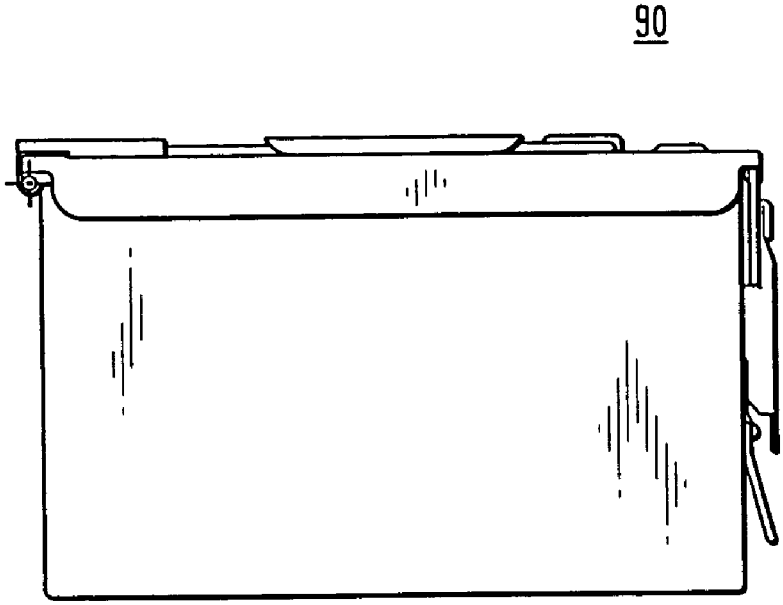
FIG. 7 is comprised of FIGS. 7A and 7B, that respectively illustrate a side view and a front view of a metal ammunition container made according to the present invention for storing the explosive loaded cartridges of FIG. 1.
Figure 7B:
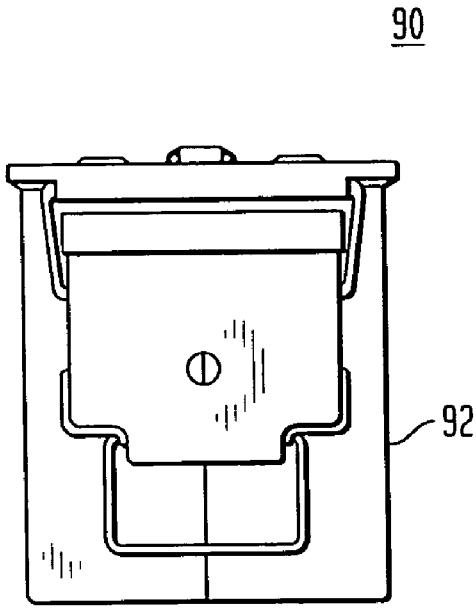

With reference to FIG. 7, a plurality of fiberboard tubes 70 each containing an explosive loaded cartridge 10 are packaged inside a metal ammunition container 90. An exemplary metal ammunition container 90 for storing the exemplary 60 mm M720A1 cartridge is the PA 124 metal container, which holds eight of the explosive loaded cartridges 10 packaged inside fiber tubes 70.

A further novelty of the present invention is an intumescent coating 92 deposited onto the exterior or interior surface of the metal ammunition container 90. The intumescent coating 92 is typically used in the construction industry to protect structural members such as steel beams in fires.

In the event of an unplanned thermal stimulus such as an external heat or fire source, the intumescent coating 92 on the metal ammunition container 90 insulates the fiberboard tubes 70 and the explosive loaded cartridges 10 packaged therein from the fire, and further abates the rate of heating of the explosive loaded cartridges 10. The gradual heating inside the metal ammunition container 90 ensures that the threaded fuze adapter 12 reaches its melting temperature prior to the main charge explosive 28 reaching its auto-ignition temperature, thus preventing an accidental detonation of the explosive loaded cartridge 10.

It should be understood that the geometry, compositions, and dimensions of the elements described herein can be modified within the scope of the invention and are not intended to be the exclusive; rather, they can be modified within the scope of the invention. Other modifications can be made when implementing the invention for a particular environment.

What is claimed is:

1. A system of explosive loaded projectiles protected from chain explosion caused by possibility of fire, with reduced probability of accidental detonation of the projectiles when subjected to an unplanned thermal stimulus, comprising projectiles that have:

a projectile body having a forward end, an aft region, and an inner surface, said forward end having a cylindrical opening for placement of a fuze, said opening having internal threads disposed therein, said projectile body having explosive disposed within the inner surface thereof;

said fuze comprising a plug end, said plug end having external threads thereon;

an annular cylindrically shaped ionomer plastic member, said plastic member having external threads which are sized so as to mate with said internal threads of said projectile body cylindrical opening, and said plastic member having internal threads to match the fuze plug external threads, said plastic member being disposed wholly internal to said fuze body cylindrical opening annularly surrounding said plug region of said fuze, so as to secure said fuze to said projectile body and support the fuze therein, wherein said plastic member softens at a temperature substantially below the auto-ignition temperature of said explosive and by a factor of at least 40% below such auto-ignition temperature, said plastic member softening at a temperature of 200 degrees Fahrenheit to about 206 degrees Fahrenheit, such that during an unplanned thermal stimulus the plastic member softens or melts so as to no longer firmly secure and support said fuze within said projectile body, whereby if combustion gases are generated by an auto-ignition of said explosive, such gases can vent around said fuze plug or cause said fuze to detach or be expelled to likewise vent such gases; said allowance for venting of such gases preventing a more seriously potent explosion of the projectile body were it a fully sealed device if completely closed by the fuze without possibility of venting of gases;

wherein the explosive loaded projectiles are stored in an accompanying box, said box fully coated externally and internally with an intumescent paint, said intumescent paint slowing the advance of a fire external to said box, such that the temperature of the projectiles in the box advances at a slower rate of heating to more assuredly allow heat to be adequately absorbed in each projectile plastic member sufficient to soften such members prior to the time that the explosive of a projectile can reach its auto-ignition temperature thus more assuredly allowing for the possibility of venting of combustion gases at such time when the explosive might reach its auto-ignition temperature.

2. The system of claim 1, wherein the plastic member has a diameter of approximately 1.5 inches.

3. The system of claim 2, wherein the plastic member has a length of approximately 0.64 inch.

4. The system of claim 1, wherein the projectile body is made of a steel shell having an ogival shape.

5. The system of claim claim 1, further including an obturating ring secured to the body.

6. The system according to claim 5, further including a tail fin.

7. The system of claim 6, wherein the body is secured to the tail fin via a threaded portion.

8. The system of claim 7, wherein the tail fin comprises a plurality of fins that maintain a flight path of the projectile.

9. The system of claim 8, wherein the tail section further comprises an ignition cartridge.

10. The system of claim 9, wherein the tail fin further comprises a plurality of vent holes.

11. The system of claim 10, wherein the tail section further comprises a plurality of propelling charge containers for holding a propelling charge; and wherein upon firing of the projectile, the ignition cartridge is impacted to cause the propelling charge to combust inside the tail fin, which, in turn, causes the propelling charge outside the tail fin to combust and to generate a combustible gas and pressure to propel the projectile forward in flight.

12. A system of explosive loaded projectiles protected from chain explosion caused by possibility of fire, with reduced probability of accidental detonation of the projectiles when subjected to an unplanned thermal stimulus, comprising projectiles that have:

a. projectile body having a forward end, an aft region, and an inner surface, said forward end having a cylindrical opening for placement of a fuze, said opening having internal threads disposed therein, said projectile body having COMP B explosive disposed within the inner surface thereof;

said fuze comprising a plug end, said plug end having external threads thereon;

an annular cylindrically shaped ionomer plastic member, said plastic member having external threads which are sized so as to mate with said internal threads of said projectile body cylindrical opening, and said plastic member having internal threads to match the fuze plug external threads, said plastic member being disposed wholly internal to said fuze body cylindrical opening annuarly surrounding said plug region of said fuze, so as to secure said fuze to said projectile body and support the fuze therein, wherein said plastic member softens at a temperature substantially below the auto-ignition temperature of said explosive and by a factor of at least 40% below such auto-ignition temperature, said plastic member softening at a temperature of 200 degrees Fahrenheit to about 206 degrees Fahrenheit, such that during an unplanned thermal stimulus the plastic member softens or melts so as to no longer firmly secure and support said fuze within said projectile body, whereby if combustion gases are generated by an auto-ignition of said explosive, such gases can vent around said fuze plug or cause said fuze to detach or be expelled to likewise vent such gases; said allowance for venting of such gases preventing a more seriously potent explosion of the projectile body were it a fully sealed device if completely closed by the fuze without possibility of venting of gases.

* * * * *